US006073599A

United States Patent [19]

Kimura

[11] Patent Number: 6,073,599

[45] Date of Patent: Jun. 13, 2000

[54] ENGINE DECOMPRESSION DEVICE

[75] Inventor: Sakayuki Kimura, Hamamatsu, Japan

[73] Assignee: Sanshin Kogyo Kabushiki Kaisha, Hamamatsu, Japan

[21] Appl. No.: 09/020,770

[22] Filed: Feb. 9, 1998

Related U.S. Application Data

[62] Division of application No. 08/694,482, Aug. 7, 1996, Pat. No. 5,816,208.

[30] Foreign Application Priority Data

Aug. 7, 1995 [JP] Japan ..... 7-201058

[51] Int. Cl.[7] ..... F01L 13/08

[52] U.S. Cl. ..... 123/182.1; 123/195 P

[58] Field of Search ..... 123/182.1, 90.33, 123/90.34, 195 P, 90.27

[56] References Cited

U.S. PATENT DOCUMENTS

| | | | |
|---|---|---|---|
| 3,362,390 | 1/1968 | Esty | 123/182.1 |
| 3,511,219 | 5/1970 | Esty | 123/182.1 |
| 4,721,485 | 1/1988 | Suzuki | 123/195 P |
| 5,653,199 | 8/1997 | Ishiuchi et al. | 123/182.1 |

FOREIGN PATENT DOCUMENTS

| | | | |
|---|---|---|---|
| 3-294610 | 12/1991 | Japan | 123/182.1 |

*Primary Examiner*—Andrew M. Dolinar

*Attorney, Agent, or Firm*—Knobbe, Martens, Olson & Bear LLP

[57] ABSTRACT

An outboard motor embodying a four-cycle internal combustion engine having a decompression device for automatically reducing the compression ratio to assist in pull starting. The decompression device is mounted and operated through one end of the cam shaft and thus facilitates modification of engines so as to incorporate this feature or not incorporate the feature. The construction also facilitates lubrication of a centrifugal mechanism that actuates the decompression device.

15 Claims, 8 Drawing Sheets

ENGINE DECOMPRESSION DEVICE

CROSS-REFERENCE TO RELATED APPLICATION

This application is a division of my application of the same title, U.S. Ser. No. 08/694,482, filed Aug. 7, 1996, now issued as U.S. Pat. No. 5,816,208 on Oct. 6, 1998.

BACKGROUND OF THE INVENTION

This invention relates to an engine starting assisting device and more particularly to an engine decompression device.

In many engine applications, the operator may be called upon to manually start an internal combustion engine. This may be true whether or not the engine is also provided with an electrical or otherwise operated self-starting mechanism. For example, it is frequently the practice in outboard motors, and particularly those of small displacement, to incorporate a mechanism whereby the engine may be manually started. This is normally done by a rope or recoil starter mechanism that is associated with a flywheel on the upper end of the crankshaft.

However, in order to achieve good engine performance, it is also the practice to use relatively high compression ratios. The use of such high compression ratios, however, gives rise to rather large forces that must be overcome by the operator to effect manual starting. There have been, therefore, proposed types of devices which effectively lower the compression ratio of the engine during this manual starting procedure. Preferably, such devices should be operative so as to be automatic in nature wherein the compression ratio is lowered only long enough so as to facilitate starting and so as to not interfere with the running of the engine once starting has been accomplished.

Therefore, these previously proposed systems have tended to be somewhat complicated and cumbersome in nature. In addition, they may also have the disadvantage of interfering with the normal operation of the engine.

It is, therefore, a principal object of this invention to provide an improved and simplified decompression device for assisting in engine starting.

It is a further object of this invention to provide an improved, automatic starting decompression device that is operative to reduce the compression ratio only long enough so as to facilitate manual starting and without interfering with the continued running of the engine once starting has been accomplished.

From the foregoing description it should also be readily apparent to those skilled in the art that certain engines may, in some applications, require such decompression devices. In other applications for the same basic engine, however, the decompression device need not be required. For example, in making small displacement outboard motors, electric starters may be offered as an option on some displacements. Where an electric starter is incorporated, the decompression device need not be required. However, if an electric starter is not available or not purchased as an option, then the decompression device may be desirable or an acceptable alternative in lieu of electric starting. The previously-proposed systems, however, have been fairly substantially built into the engine design and the optional addition or subtraction of these features has not been available.

It is, therefore, a still further object of this invention to provide an improved decompression device for an engine that can be easily added or deleted from a given engine with a minimum change in parts and configuration.

It is a further object of this invention to provide an improved decompression device for an engine for facilitating starting and wherein the decompression device can be installed without necessitating substantial disassembly of the engine or without involving modification of the basic engine design.

As has been noted, it is desirable to ensure that the decompression device can operate automatically. One way which this can be done, in accordance with the invention, is by utilizing a centrifugal clutch or centrifugal actuator. As a result, when the engine speed is below a certain speed, the decompression may be effected. However, when that speed is exceeded, the decompression is automatically disabled.

The desirability of maintaining versatility in either utilizing or not utilizing a decompression device with a given engine has already been described. Where centrifugal actuating mechanisms are required, however, it may be desirable or necessary to provide lubrication for certain components of the mechanism.

It is, therefore, a still further object of this invention to provide an improved decompression device and lubrication system therefor when the lubrication system will be effective to lubricate the decompression device when it is installed and which need not be separately built into the engine for the specific application incorporating the decompression device.

That is, it is a further object of this invention to provide a basic engine construction embodying a lubrication system wherein the addition of a decompression device can be accomplished and the existing engine construction will effect lubrication of the decompression device without substantial modification.

SUMMARY OF THE INVENTION

A first feature of this invention is adapted to be embodied in an internal combustion engine having a cylinder block formed with at least one cylinder bore. A crankshaft is journaled for rotation relative to the cylinder block and is driven by a piston that reciprocates in the cylinder bore. A cylinder head closes the cylinder bore. Intake and exhaust valves cooperate with intake and exhaust passages for admitting a charge to a combustion chamber formed by the cylinder bore, piston and cylinder head and for discharging a burnt charge from the combustion chamber. A cam shaft is driven in timed relationship with the crankshaft and cooperates with at least the exhaust valve for opening and closing the exhaust valve in timed sequence with the angular position of the crankshaft. The cam shaft incorporates selectively operable means for cooperating with the exhaust valve at a time during the compression stroke for selectively opening the exhaust valve and reducing the compression for facilitating manual starting.

In accordance with another feature of the invention, the means that cooperates with the exhaust valve for opening the exhaust valve during a portion of the compression stroke includes an operating element that extends through the cam shaft and which is accessible at one end of the cam shaft. An automatic operator cooperates with this exposed portion for operating the decompression device from externally of the engine.

In accordance with a still further feature of the invention, the automatic operator includes a centrifugal device that is adapted to be mounted at the one end of the cam shaft and which can be lubricated by the lubricating system provided for the normal lubrication of the cam shaft without requiring additional flow passages.

DETAILED DESCRIPTION OF THE PREFERRED EMBODIMENTS

Figure 1:
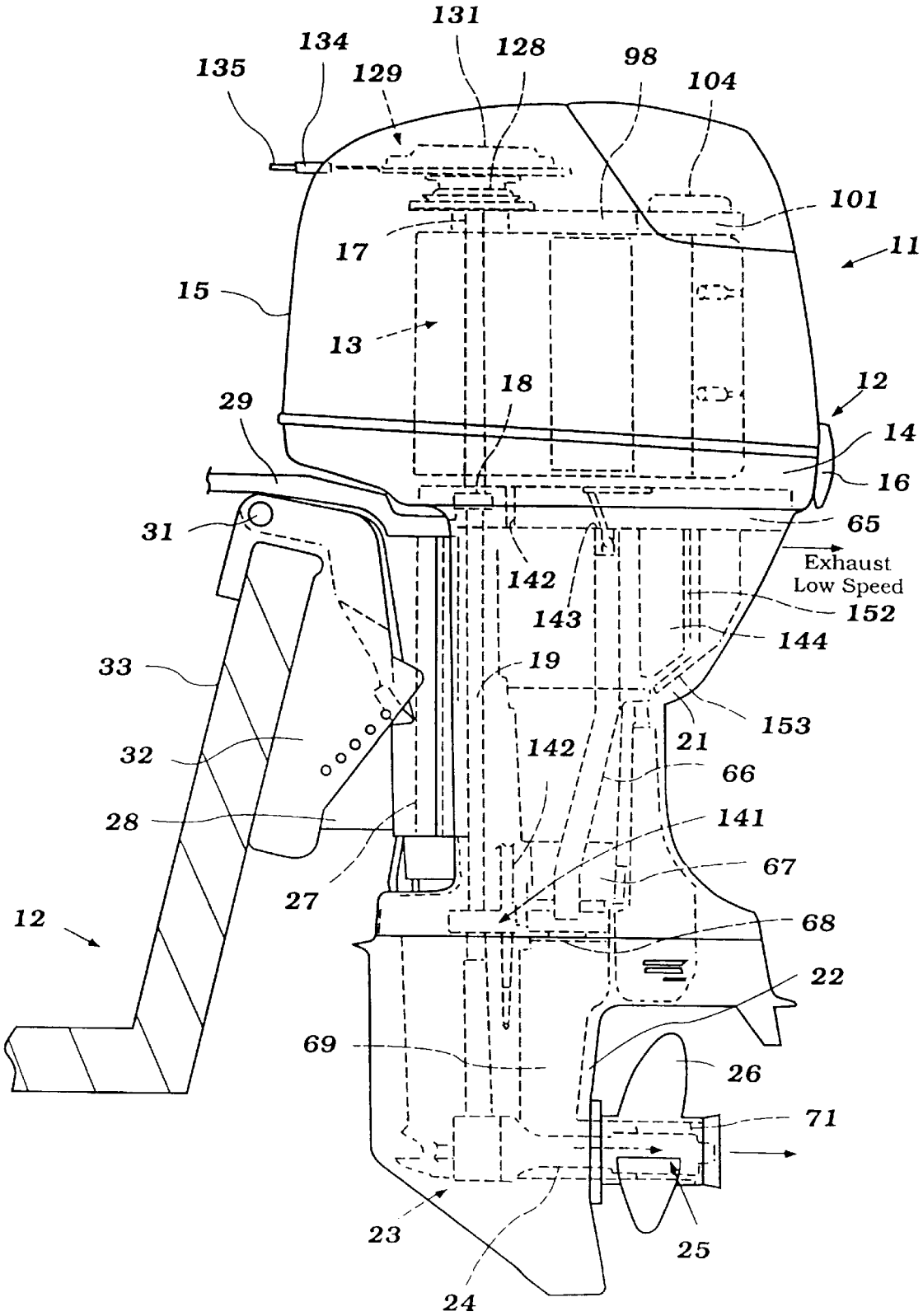
FIG. 1 is a side elevational view of an outboard motor constructed in accordance with a first embodiment of the invention, shown attached to the transom of a watercraft, illustrated partially and in cross section.

Referring now in detail to the drawings and initially to FIG. 1, an outboard motor constructed in accordance with an embodiment of the invention is identified generally by the reference numeral 11 and is depicted as being attached to the transom of a watercraft, indicated generally by the reference numeral 12. The watercraft 12 is shown partially and in cross section. It is to be understood that the invention is described in conjunction with an outboard motor such as the outboard motor 11 because the invention has a particular utility with such engine applications. The invention, however, can be utilized with a wide variety of other types and applications for internal combustion engines. As will become apparent to those skilled in the art from the following description, however, the invention has particular utility with outboard motors because of the fact that their output shafts rotate generally about vertically disposed axes rather than horizontal axes as is more typical with other forms of engine applications.

Also, the application of the invention to an outboard motor such as the outboard motor 11 is a particularly advantageous environment in which the invention can be practiced. This is because outboard motors, although they frequently include electric starting mechanisms, generally are constructed in such a way so that they can be capable of manual starting. This manual starting is desirable in order to provide for emergency starting capability. In addition and particularly with respect to smaller displacement outboard motors, a given engine may be offered as an alternative coupled with an electrical starting mechanism or only a manual start system. As will become apparent from the foregoing description, the invention is particularly adapted for utilization with such engines having such alternate constructions.

Referring now in more detail to the outboard motor 11, it is comprised of a powerhead, indicated generally by the reference numeral 12 which includes a powering internal combustion engine 13 and a surrounding protective cowling. This protective cowling is comprised of a lower tray portion 14 which may be formed of an aluminum or aluminum alloy metal piece or some other suitably rigid construction. A main cowling member, 15 is provided that is detachably connected to the tray 14 by means which includes a latch mechanism 16. The main cowling portion 15 is formed from a lighter-weight material than the tray such as a molded fiberglass reinforced resin or the like.

As is typical with outboard motor practice and as has been aforenoted, the engine 13 is supported within the powerhead 12 so that its crankshaft 17 rotates about a vertically extending axis. This facilitates coupling by means of a coupling member 18 to the upper end of a drive shaft 19. The drive shaft 19 is also supported for rotation about a vertically extending axis and depends into a drive shaft housing 21. The drive shaft 19 is rotatably journaled therein in any suitable manner.

At its lower end, the drive shaft 19 depends into a lower unit 22 where there is provided a forward, neutral, reverse transmission 23 for selectively driving a propeller shaft 24 in forward or reverse directions. Affixed to the rear end of the propeller shaft 24 is a propeller 25 having one or more blades 26 which function so as to provide a propulsive force for driving the associated watercraft 12 through the body of water in which it is operating.

Affixed to the drive shaft housing 21 in a known manner is a steering shaft 27. This steering shaft 27 is, in turn, journaled within a swivel bracket 28 for steering of the outboard motor 11 about a generally vertically extending steering axis. A tiller 29 is affixed to the upper end of the steering shaft 27 so as to accomplish this steering action.

The swivel bracket 28 is pivotally connected by means of a pivot pin 31 to a clamping bracket 32. The clamping bracket 32 is detachably affixed to a transom 43 of the watercraft 12 in a known manner. The pivotal connection afforded by the pivot pin 31 permits tilt and trim movement and adjustment of the outboard motor 11 about a generally horizontally disposed axis, as is also well known in this art.

The construction of the outboard motor 11 as thus far described may be considered to be conventional. For that reason, further description of the conventional components of the outboard motor are not believed to be necessary to permit those skilled in the art to practice the invention. Where any details of the construction of the outboard motor 11 are not illustrated or described, they may be considered to be conventional and reference may be had to any conventional structures for those which may be utilized in conjunction with the invention.

The invention deals primarily with the certain features of the engine 13 are particularly those which facilitate its manual starting. The construction of the engine 13 will now be described in more detail by a particular reference initially to FIGS. 2 and 3, although some of these components may also appear in the remaining figures. The engine 13 is, in the illustrated embodiment of the two cylinder in-line type as will become apparent from the following description. Although the invention is described in conjunction with the engine of this configuration, it will be readily apparent to those skilled in the art how the invention can be practiced with engines having other cylinder numbers than other cylinder types. The invention, however, has particular utility in conjunction with smaller displacement engines since these engines frequently employ and rely heavily upon manual starting mechanisms.

The engine includes a cylinder block 34 that forms, in the illustrated embodiment, two horizontally extending cylinder bores 35. These bores 35 are formed, in the illustrated embodiment, by pressed or cast in-liners 36. Of course, other manners of forming the cylinder bores may be employed without departing from the invention.

The lower ends of the cylinder bores 35 are closed by a crankcase member 37 so as to define a crankcase chamber 38. The crankshaft 17 rotates in this crankcase chamber 38 and is journaled in a manner which will be described. The opposite ends of the cylinder bores 31 are closed by a cylinder head assembly 39. The cylinder head assembly 39 is detachably connected to the cylinder block 34 in a suitable manner.

Pistons 41 reciprocate in the cylinder bores 35. The heads of these pistons 41 cooperate with recesses 42 formed in the lower surface of the cylinder head assembly 39 and with the cylinder bores 35 to form the combustion chambers of the engine. The pistons 41 are connected by means of piston pins 43 to the upper or small ends 44 of connecting rods, indicated generally by the reference numeral 45. These connecting rods 45 have big ends 46 that are journaled on throws 47 of the crankshaft 17. As may be seen in FIG. 2, the crankshaft 17 has main bearing portions 48 that are journaled for rotation in the crankcase chamber 38 by main bearings 49.

An induction system, indicated generally by the reference numeral 51 is provided for delivering a charge to the combustion chambers of the engine through the cylinder head recesses 42. This induction system 51 includes an air inlet device 52 that is positioned adjacent to and at one side of the crankcase member 37. This draws air from within the protective cowling. This air is admitted through an atmospheric air inlet 53 formed in the main cowling member 15 at the rear end thereof.

This air is then delivered to a charge forming system, such as a carburetor 54 for each cylinder bore 35. The carburetors 54, in turn, deliver the charge to a respective intake passage 55 formed on the intake side of the cylinder head assembly 39 and which terminates at a valve seat 56 or intake port formed in the cylinder head recess 42. A poppet-type intake valve 57 is operated by an actuating mechanism as will be described so as to control the flow of the intake charge into the combustion chambers.

The charge which is admitted to the combustion chambers is fired by spark plugs (not shown). The spark plugs are, in turn, fired by an appropriate ignition system in timed interval with the rotation of the crankshaft 17 as is well known in this art.

Figure 4:
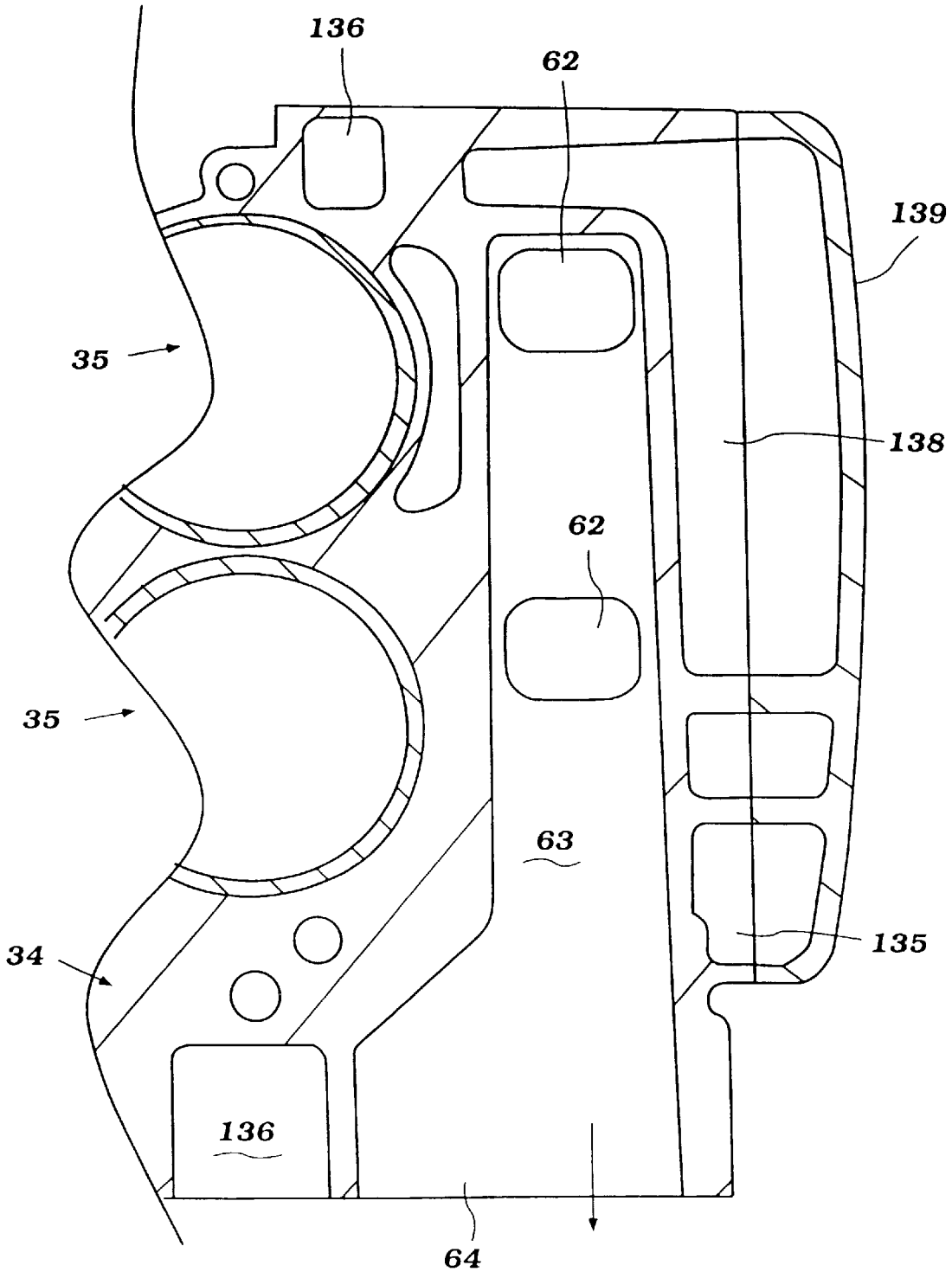
FIG. 4 is an enlarged cross-sectional view taken along the line 4—4 of FIG. 3 and shows the exhaust manifolding system.

The burnt charge is then discharged from the combustion chambers through exhaust ports 58 formed in the cylinder head assembly 39 on the side opposite the intake system 53. Poppet-type exhaust valves 59 control the opening and closing of the exhaust ports 58 in a manner which will also be described. When the exhaust valves 59 are open, the exhaust gases can exit through exhaust passages 61 which extend through the corresponding side of the cylinder head assembly 39. These exhaust passages communicate at the cylinder block engaging surface of the cylinder head assembly 39 with runner section 62 of an exhaust manifold 63 which is formed integrally in the cylinder block 34. This exhaust manifold 63 appears in most detail in FIG. 4. The exhaust manifold 63 extends downwardly to a discharge opening 64 formed in a lower face of the cylinder block 34.

The exhaust manifold discharge opening 64 communicates with a corresponding opening formed in an exhaust guide 65 (FIG. 1) which is mounted beneath the engine 13 and at the upper portion of the drive shaft housing 21. One or more exhaust pipes 66 are affixed to the underside of this exhaust guide and discharge the exhaust gases into an expansion chamber system 67 formed in the drive shaft housing 21 and extending into the lower unit 22. A restricted opening 68 communicates the expansion chamber with a further expansion chamber 69 formed in the lower unit. The exhaust gases discharge to the atmosphere from this expansion chamber 69 through a conventional through-the-hub exhaust gas discharge 71 formed in the hub of the propeller 25. The path of exhaust flow from the exhaust system as thus far described is indicated by the arrows in FIG. 1.

In addition, the outboard motor may be provided with an above the water, low speed exhaust gas discharge which includes a further discharge path indicated by the arrow in FIG. 1. This discharge path is much more restricted but permits the exhaust gases to exit when the underwater discharge 71 is deeply submerged because of low-speed travel of the watercraft, as is also well known in this art.

The valve actuating mechanism that operates the intake valves 57 and the exhaust valves 59 will now be described by initial primary reference to FIGS. 2, 3, and 5. This valve actuating mechanism is indicated generally by the reference numeral 74 and is comprised of a single overhead cam shaft, indicated generally by the reference numeral 75 which operates the valves through a rocker arm arrangement so as to provide a hemispherical shape combustion chamber.

Figure 5:
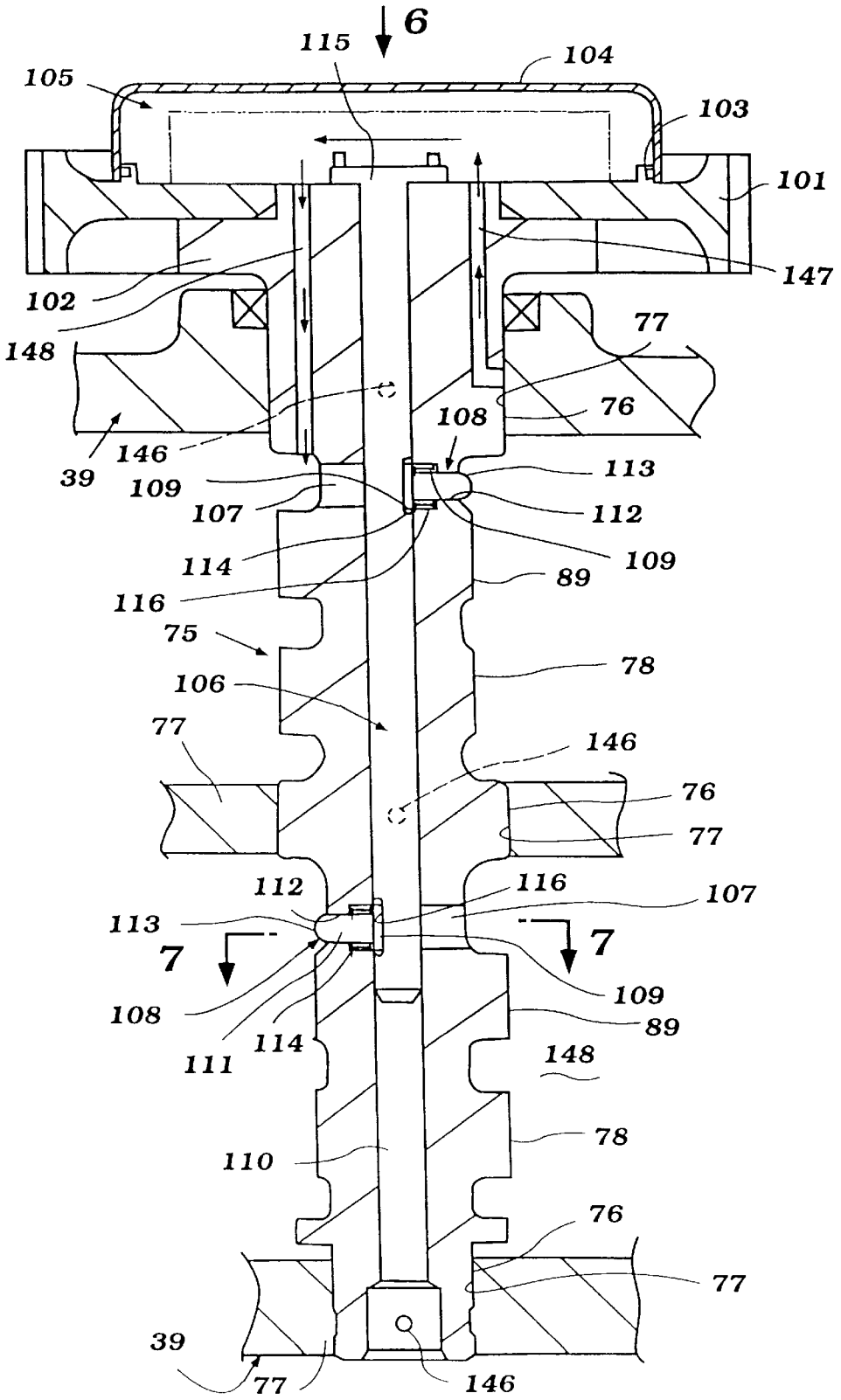
FIG. 5 is an enlarged cross-sectional view taken along the same plane as FIG. 2 and more particularly illustrates the decompression mechanism for the cam shaft.

The cam shaft 75 has, as best shown in FIG. 5, a plurality of spaced bearing surfaces 76 which are appropriately journaled in bearing surfaces formed integrally with the cylinder head assembly 39 and bearing caps which are affixed thereto. These bearing surfaces are indicated by the reference numerals 77.

The area between the cam shaft bearing surfaces 76 is formed with first intake cam lobes 78 which cooperate with intake rocker arms 79. The intake rocker arms 79 are journaled for pivotal movement on a rocker arm shaft 81 which is, in turn, fixed to the cylinder head assembly 39 by fasteners 82. These intake cam shaft rocker arms 79 have follower portions 83 which are engaged with the intake cam lobe 78 and which effect pivotal movement of the rocker arms 79 upon rotation of the cam shaft 75, which cam shaft is driven in a manner to be described.

Each intake valve 57 is urged toward its closed position by means of a coil compression spring 84. The coil compression springs 84 are loaded between a machined surface of the cylinder head assembly 39 and keeper retainer assemblies 85 that are affixed to the stems of the intake valves 57 in a known manner. These springs urge the tips of the valve stems of the intake valves 57 toward contact with adjusting screws 86 that are held in place by lock nuts 87. These adjusting screws are held in place in valve actuating ends 88 of the intake rocker arms 79.

In a similar manner, the cam shaft 75 is formed with exhaust cam lobes 89 which are formed adjacent the intake cam lobes 78 and also between the cam shaft bearing surfaces 76. These exhaust cam lobes 89 cooperate with follower portions 91 of exhaust rocker arms, indicated generally by the reference numeral 92. These exhaust rocker arms 92 are also journaled on the rocker arm shaft 81. The exhaust rocker arms 92 have actuating ends 93 which are juxtaposed to the tips of the exhaust valves 59. These actuating ends carry adjusting screws 94 which are locked in adjusted position by lock nuts 95 and which engage the tips of the exhaust valves 59 for their actuation.

Like the intake valves, the exhaust valves 59 are urged toward their closed position by coil compression springs 96. The springs 96 act against machine surfaces formed on the cylinder head 39 and keeper retainer assemblies 97 fixed in a known manner to the tips of the stems of the exhaust valves 59.

Figure 2:
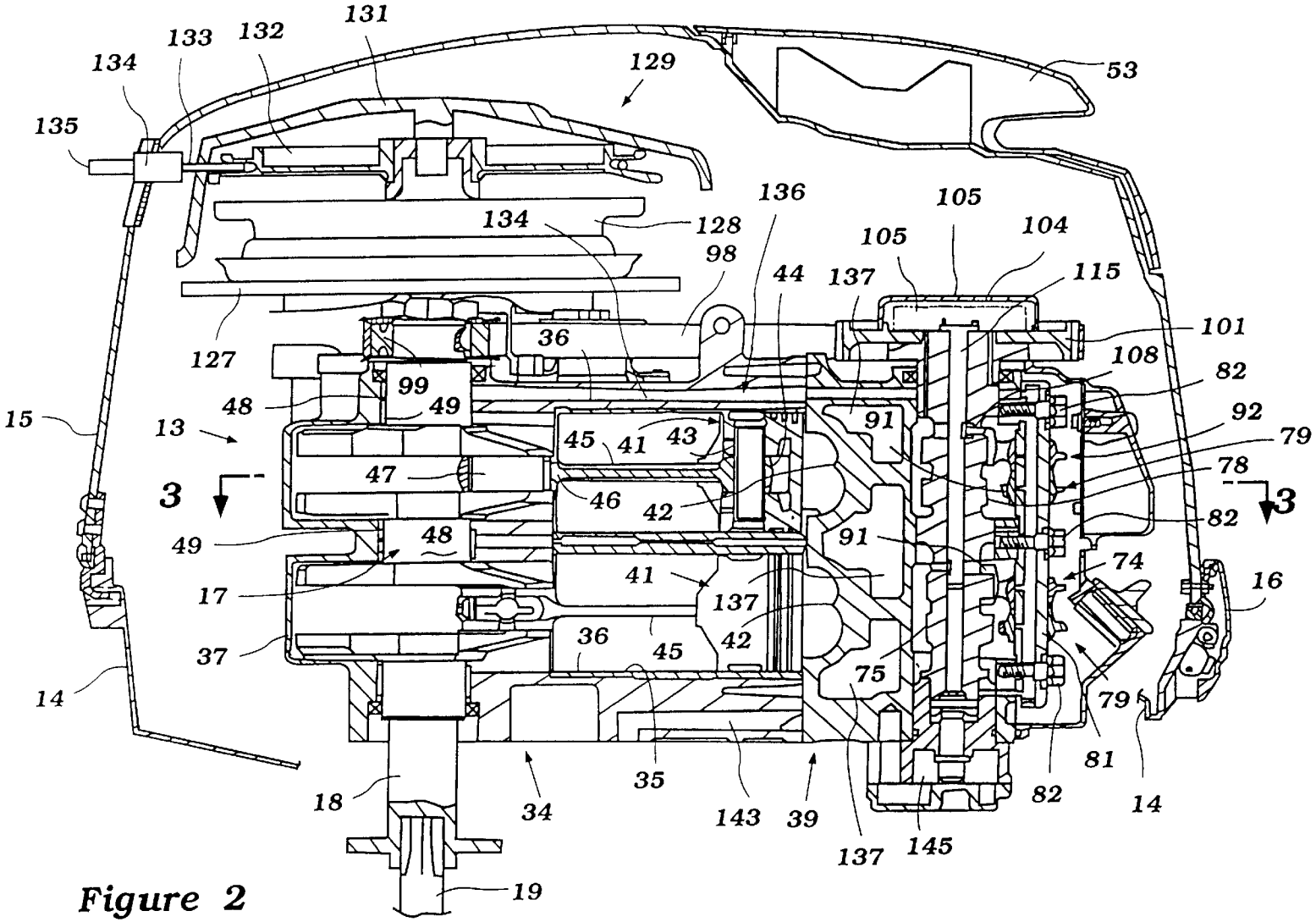
FIG. 2 is an enlarged cross-sectional view taken through the powerhead of the outboard motor illustrated in FIG. 1.
Figure 3:
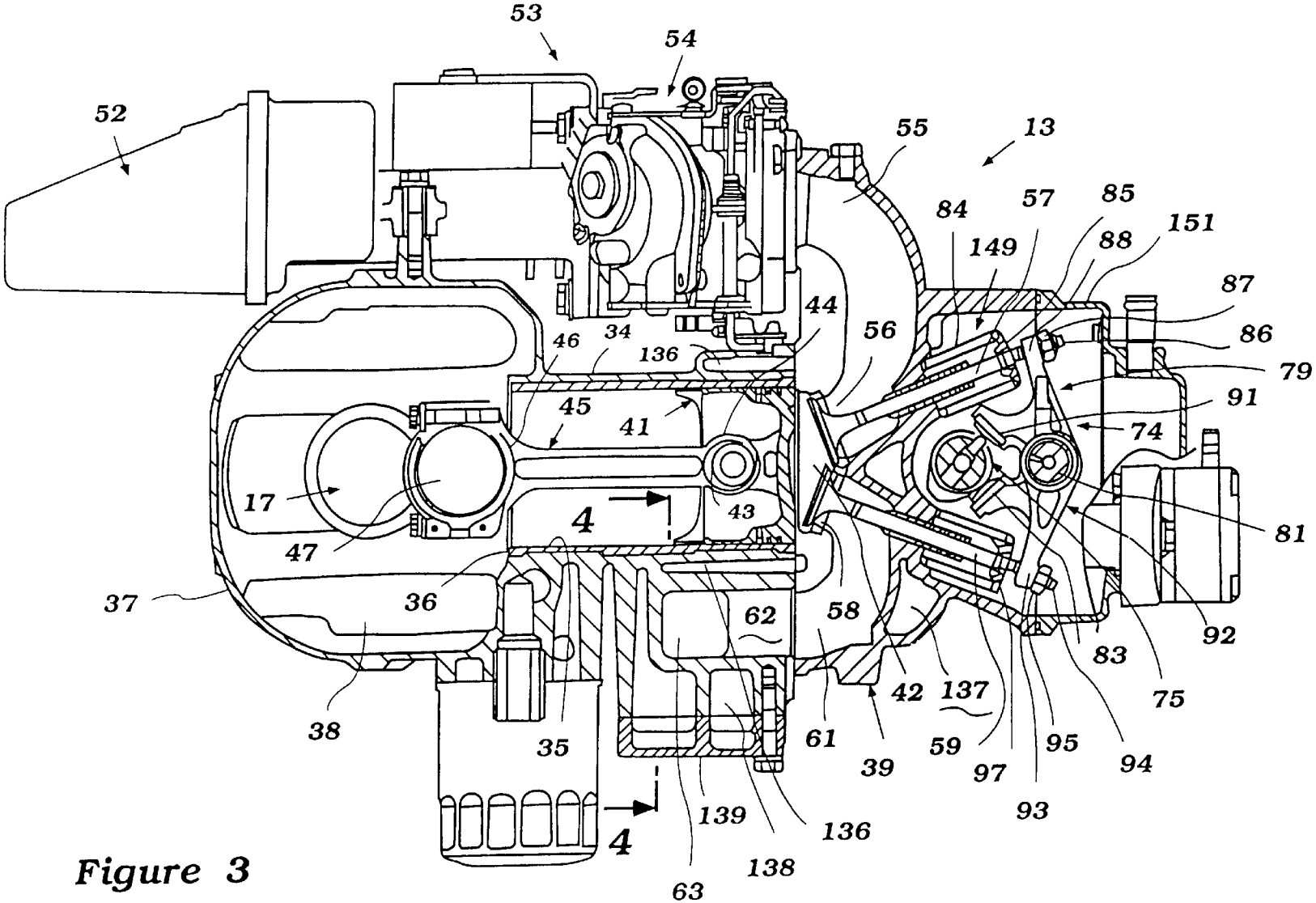
FIG. 3 is a cross-sectional view taken along the line 3—3 of FIG. 2.

The cam shaft 75 is rotatably driven by the engine crankshaft 17 by a flexible transmitter, in this case a toothed timing belt which is best shown in FIGS. 2 and 5. This timing belt is indicated generally by the reference numeral 98 and is engaged with a driving sprocket 99 that is fixed for rotation at a portion of the upper end of the crankshaft 17 that extends beyond the crankcase chamber 38. The belt 98 is further entrained with a driven sprocket 101 that is fixed, in a manner to be described, to the upper end of the cam shaft 75. The sprocket 101 has a diameter which is exactly double that of the diameter of the sprocket 99 so as to drive the cam shaft 75 at one-half crankshaft speed, as is well known in this art.

The cam shaft 75 is formed with a flange portion 102 adjacent the upper cylinder head bearing surface 76 and which axially fixes the driving sprocket 101 thereupon. The upper side of the timing sprocket 101 is provided with an extending portion that carries an O-ring seal 103 that cooperates with a cover plate 104 that can be selectively attached thereto in order to contain a centrifugal actuating mechanism, indicated generally by the reference numeral 105 and shown in most detail in FIG. 6. This centrifugal actuating mechanism 105 operates in a manner which will be described so as to rotate a decompression actuating shaft 106 that is rotatably journaled within an axially extending bore 110 that extends through the cam shaft 75.

Figure 7:
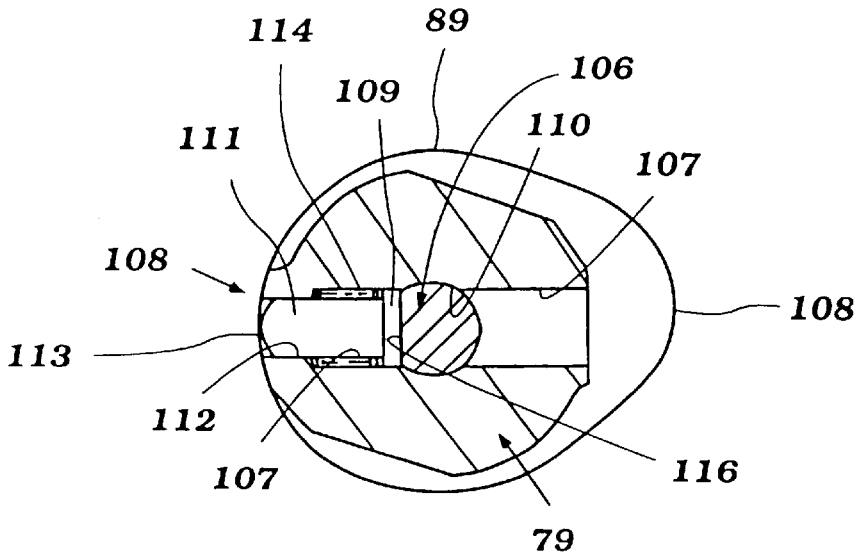
FIG. 7 is an enlarged cross-sectional view taken along the line 7—7 of FIG. 5 and shows the decompression mechanism in the normal running condition.
Figure 8:
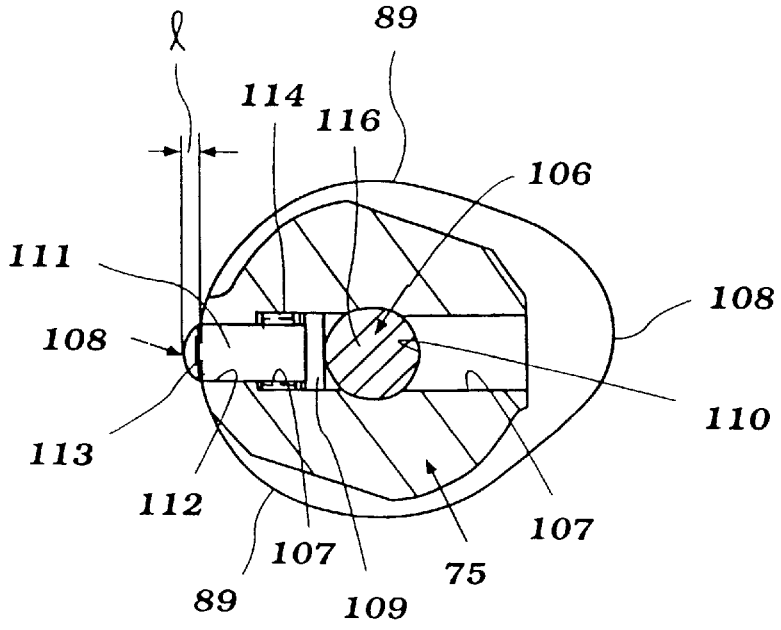
FIG. 8 is a cross-sectional view, in part similar to FIG. 7, but shows the mechanism in the decompression position.

The actual structure which achieves the decompression is best seen in FIGS. 5, 7, and 8 and will be described now by particular reference thereto. The area of the cam shaft 75 adjacent each exhaust cam lobe 89 is provided with an enlarged counter bore 107 so as to permit insertion therethrough of a decompression pin, indicated generally by the reference numeral 108. The large diameter counterbore 107 is aligned specifically with the toe part 108 of each of the exhaust cam lobes 89. The reasons for this will become apparent shortly.

Each decompression pin 108 has an enlarged diameter headed portion 109 which is slightly smaller than the diameter of the counterbore 107 to facilitate its passage therethrough. This headed portion 109 is integrally formed with a pin portion 111 which extends through and is slidably supported in a smaller diameter bore 112 that is coaxial with the counterbore 107. These pin portions 111 have rounded tip ends 113 that cooperate, in a manner which will be described, with the respective exhaust valve 59 so as to provide a small degree of lift for each exhaust valve 59 when decompression is being effected so as to open the exhaust valve slightly at a point during the compression stroke to slightly relive the compression. This opening is accomplished only temporarily so as to only partially reduce the compression pressure and to facilitate hand cranking without making starting impossible. The counterbores 107 extend diametrically across the cam shaft bore 110 and thus provide recesses in which coil compression springs 114 are provided. The compression springs 114 act against the decompression pin headed portions 109 so as to normally urge the decompression pins 109 into the position shown in FIG. 7 where they will not engage the exhaust rocker arm follower portions 91 and thus will not effect any lifting of the exhaust valves 59 or decompression of the engine.

Figure 6:
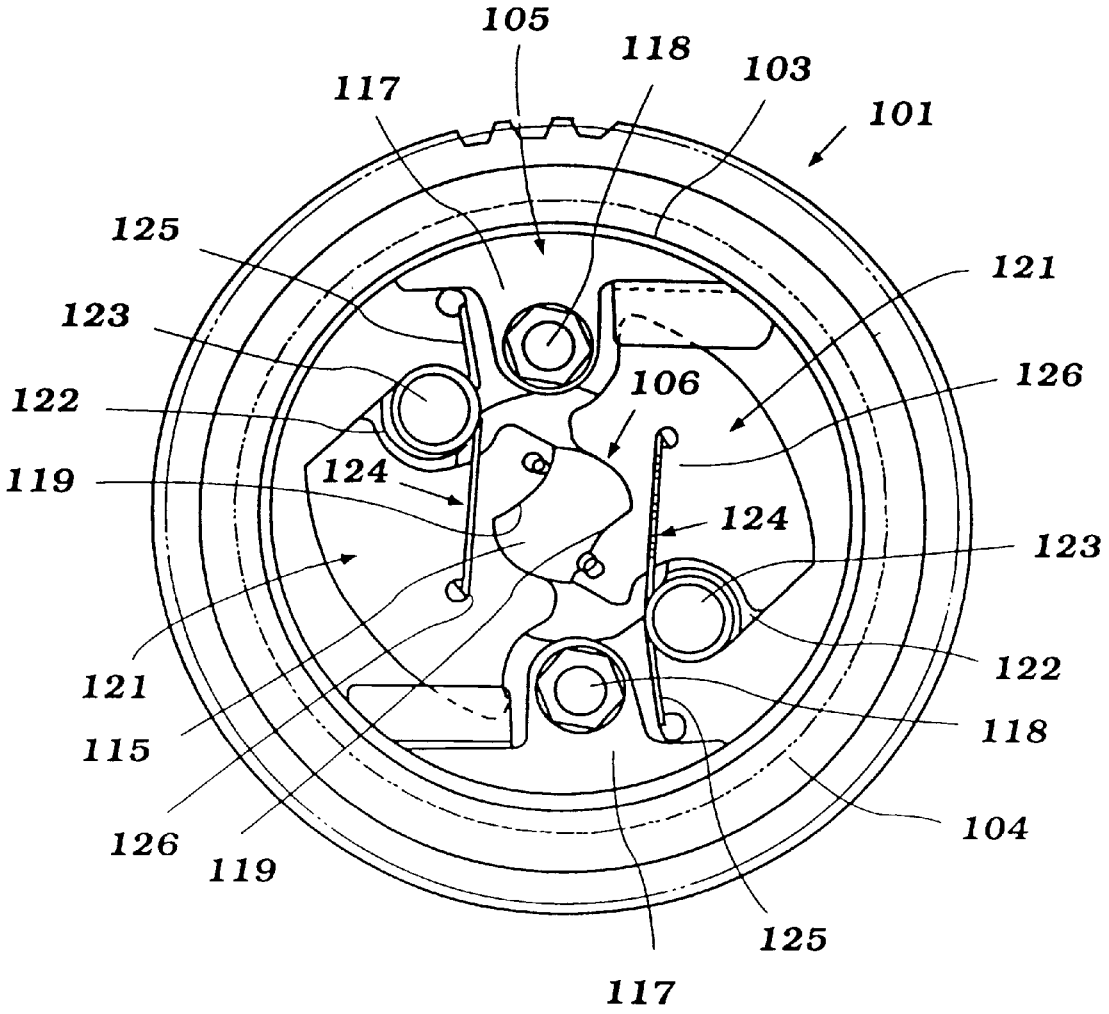
FIG. 6 is a top plan view looking generally in the direction of the arrow 6 in FIG. 5 and shows the centrifugal actuating mechanism for the decompression mechanism.

The decompression pins 107 are actuated by the decompression actuator shaft 106 which, as has been noted, is mounted for rotation in the cam shaft bore 110. The shaft 106 has a headed portion 115 which is connected to the centrifugal mechanism 1 05 as shown in FIG. 6 for its actuation. The decompression actuating shaft 106 is formed with flattened portions 116 that act as cam surfaces, in a manner which will be described, so as to effect axial movement of the decompression pins 108 in the bores 112 and counterbores 107.

FIG. 7 shows the normal running position wherein the actuating shaft 106 is in the normal, non-decompression position, this being the position when the speed of rotation of the cam shaft 75 and accordingly the speed of rotation of the engine 13 is above a predetermined speed. This predetermined speed is, as noted, the speed which is less than idle speed but greater than normal cranking speed when an operator is manually cranking the engine.

When the speed is below this speed, the decompression actuating shaft 106 will be rotated to the position shown in FIG. 8 so that the cylindrical outer surface of the shaft 106 will engage the decompression pin headed portions 109 and urge them outwardly so as to provide a small degree of lift "1" for the exhaust valves 59 during a portion of the compression stroke as aforenoted. Thus, when this low-speed manual cranking occurs, the exhaust valves 59 will be slightly opened during the cranking operation and reduce the compression pressure so that the operator can manually crank the engine 13 at a speed fast enough to initiate starting. However, as soon as the engine speed increases, then the decompression pins 108 will be returned to the position shown in FIG. 7 and the engine will operate normally.

Referring now to FIG. 6, the centrifugal mechanism 105 will be described so as to permit the reader to understand how the decompression system is moved between the positions shown in FIGS. 7 and 8. As has been noted, the centrifugal mechanism 105 is mounted within a housing 104 that is affixed to the timing sprocket 101 in the manner aforedescribed. The timing sprocket 101, in turn, has a pair of portions 117 which are affixed by threaded fasteners 118 to the cam shaft flange portion 102 so as to establish the driving interconnection therebetween.

It will be seen that the decompression actuating shaft 106 has its upper portion 115, as aforenoted, which extends into the interior of the timing sprocket 101. This portion 115 is engaged by cam surfaces 119 of a pair of inertial masses, each indicated generally by the reference numeral 121. These inertial masses are pivotally mounted by hub portions 122 thereof upon pivot pins 123 which are, in turn, staked or fixed for rotation with the timing sprocket 101. These inertial masses are biased by torsional springs 124 to the position shown in FIG. 6. These torsional springs 124 have first end portions 125 that are trapped in openings formed in the driving sprocket 101. Other end portions 126 are trapped in openings in the inertial members 121 and urge them in counterclockwise direction so as to maintain their cam surfaces 119 into corresponding engagement with the end portion 106 of the decompression device actuator 115. This is the condition when the engine is not rotating or is rotating at a speed which is below the aforenoted predetermined speed.

Thus, when the operator manually attempts to start the engine, as aforenoted, the compression will be lowered and starting facilitated. However, when the engine begins to run or, alternatively, when it is cranked at a higher speed by, for example, an electric starter, then the rotation and centrifugal force on the inertial masses 121 will cause them to rotate in clockwise directions about their pivot pins 123 against the action of the springs 125. Thus, their cam surfaces 119 will engage the portion 106 of the decompression actuator 115 and effect its rotation to the position shown in FIG. 7 wherein the effective compression ratio of the engine will be raised and it will be run normally.

The manual starting mechanism for manually starting the engine 13 in this embodiment will now be described by reference primarily to FIGS. 1 and 2 and specifically the latter of these two figures which shows the construction in more detail. A flywheel 127 is affixed to the upper end of the crankshaft 17 in a known manner. A conventional flywheel magneto-type generator mechanism 128 is mounted on the upper end of the flywheel 125. Above this construction, is a conventional recoil-type starter mechanism, indicated generally by the reference numeral 129 which includes a cover plate 131 and a rope-pulley 132. The rope pulley 132 is connected to the crankshaft 17 through a one-way clutch mechanism. A starting rope 133 is wound around this pulley 132 and passes through a guide 134 in the protective cowling main member 15. A starter handle 135 is affixed to the outer end of the starter rope for pull-starting of the engine in a conventional manner.

The cooling system for the outboard motor and specifically the engine 13 will now be described by primary reference to FIGS. 1 through 4. The engine 13 is water cooled and thus the cylinder block is formed with cooling jackets, indicated by the reference numeral 136 which generally surround the cylinder bores 35. These cylinder block cooling jackets 136 communicate with cooling jackets 137 formed in the cylinder head in a known manner including via passages that extend through the interface between the cylinder block 34 and the cylinder head assembly 39. In addition, the exhaust manifold 63 and runner section 62 are cooled by a further cooling jacket portion 138 that is formed on the outer side of the cylinder block 34 and which is closed by a closure plate 139.

Cooling water for these cooling jackets is drawn from the body of water in which the watercraft is operating through water inlet openings formed in the lower unit 22. A water pump 141 is mounted at the interface between the drive shaft housing 21 and the lower unit 22 and is driven by the drive shaft 19 in a known manner. This coolant is delivered through delivery passages 142 into the cylinder block and cylinder head cooling jackets. At least a portion of the spent coolant is then returned through a return passageway 143. The return coolant may be mixed with the exhaust gases to assist in their silencing and discharge back to the body of water in which the watercraft is operating along with the exhaust gases, as is well known in this art.

The engine 13 is also provided with a lubricating system, the bulk of which is conventional. However, in order to further understand the operation of the decompression device and its relationship to this lubricating system, the portion of the lubricating system associated with the cam shaft 75 and the decompression system and specifically the centrifugal mechanism 105 will be described. Basically, the drive shaft housing 21 contains an oil reservoir 144 (FIG. 1) for the engine lubricant from which oil is pumped by an oil pump 145 (FIG. 2) driven by the lower end of the cam shaft 75. This oil is circulated through various oil galleries to the crankshaft 17 and specifically its main journals 48. In addition, oil is delivered to the cam shaft bearing surfaces 76 through delivery ports 146 (FIG. 5) formed in the cylinder head body 39.

One of these cylinder head delivery passages also communicates with a supply passage 147 which extends axially through the uppermost bearing portion of the cam shaft 75 to the interior of the cover 104. This lubricant can then circulate through the centrifugal release mechanism 105 of the decompression device and returns back through a drain passage 148 to the cylinder head valve chamber 148. This valve chamber is closed by a cover plate 151 and the drained lubricant can be returned back to the oil tank through a suitable return passage.

A portion of the engine coolant is discharged in proximity to the oil tank 144 (FIG. 1) through a cooling jacket 152 to cool the oil. This coolant is returned to the body of water in which the watercraft 12 is operating through a return 153.

Thus, from the described construction, it should be readily apparent that the engine may be adapted to either use the decompression device with a manual starter by merely putting the decompression actuating pin 106 into the cam shaft bore 110 and inserting the centrifugal mechanism 105 and the cover plate 104. These elements are readily accessible through the upper surface of the engine and thus can be easily added as an option without changing the basic construction of the engine. This is, in fact, one of the major advantages of this construction. Furthermore, since the mechanism is disposed at the upper end of the engine it can be easily reached for servicing and/or inspection.

Figure 9:
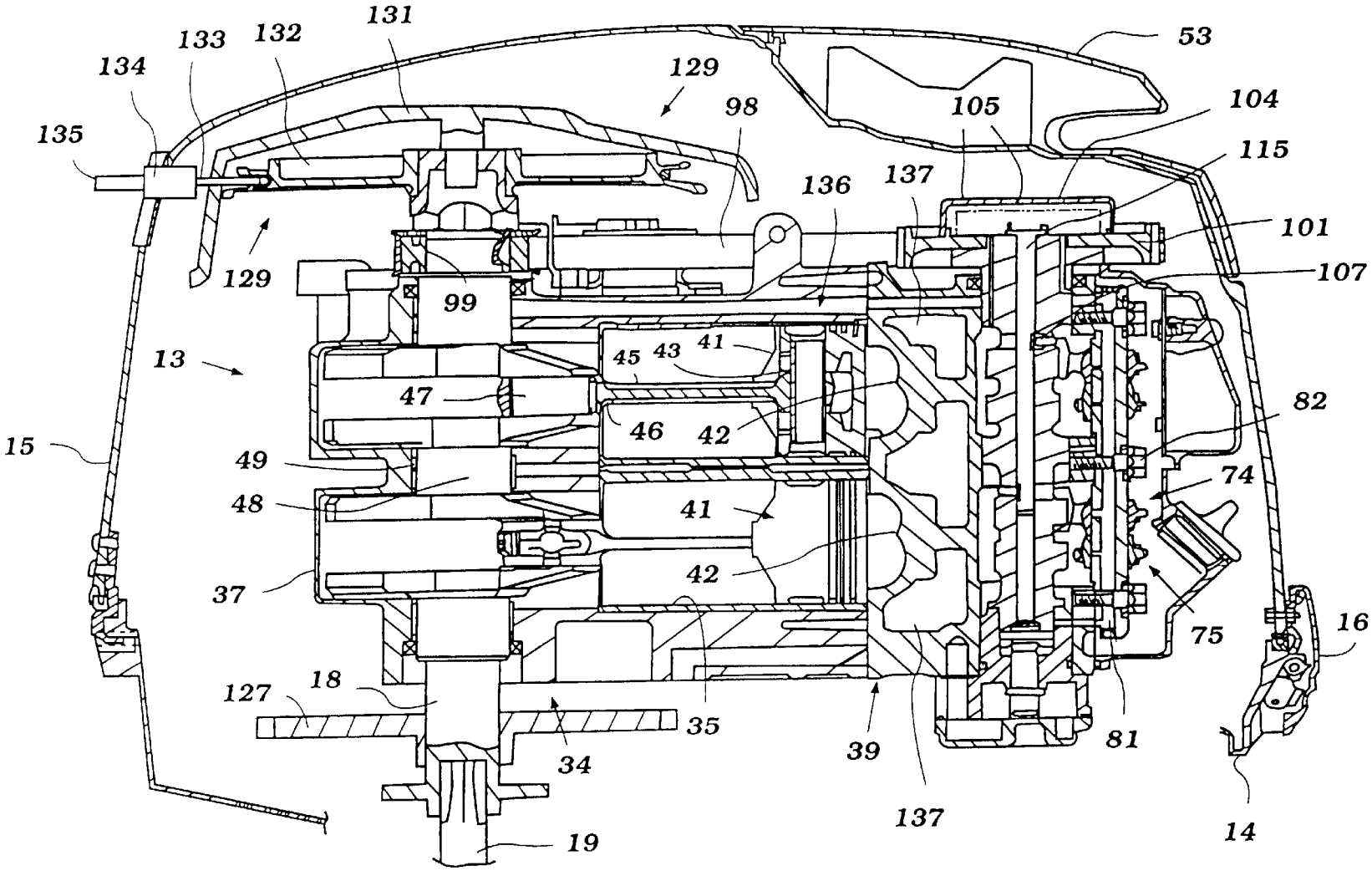
FIG. 9 is an enlarged cross-sectional view, in part similar to FIG. 2, and shows another embodiment of the invention.

FIG. 9 shows another embodiment of the invention which differs from the previously described embodiment only in the elimination of the flywheel magneto 128 and in the provision of a lower center of gravity. With this arrangement, the flywheel 127 can be mounted at the lower end of the crankshaft and this permits the lowering of the pull starting mechanism 129 and a reduction of the overall height of the engine. In all other regards this embodiment is the same as that previously described and, for that reason, a further description of this embodiment is not believed to be necessary to enable those skilled in the art to practice the invention.

Thus, from the foregoing description it should be readily apparent that a very effective and yet highly simple decompression arrangement is provided for automatically reducing the compression ratio for assisting in pulse starting. The system automatically returns to normal compression once the engine begins to run on its own and no manual manipulation is required. In addition, the interrelationship is such that the system can be easily added to the basic engine as an option without changing the overall engine construction. Of course, the foregoing description is that of a preferred embodiment of the invention and various changes and modifications may be made without departing form the spirit and scope of the invention, as defined by the appended claims.

What is claimed is:

1. An internal combustion engine having a cylinder block defining at least two cylinder bores, a crankshaft journaled for rotation at one end of said cylinder block and driven by pistons reciprocating in said cylinder bores, a cylinder head affixed to said cylinder block and closing the other end of said cylinder bores to form respective combustion chambers with said pistons and said cylinder bores, an intake passage formed in said cylinder head for supplying an intake charge to said combustion chambers, said intake passage terminating at each of said combustion chambers in a respective valve port opened and closed by a respective intake valve, exhaust passages formed in said cylinder head for discharging a burnt charge from said combustion chambers, each of said exhaust passages extending from a respective exhaust port opened and closed by a respective exhaust valve, a cam shaft journalled for rotation in said cylinder head, said cam shaft cooperating with valve actuating means for actuating said exhaust valves between respective open positions and closed positions, said cam shaft having an end portion extending outwardly beyond one end of said cylinder head and driven in timed sequence with said crankshaft by a cam shaft drive positioned externally of said cylinder block and said cylinder head, said cam shaft drive comprising a driving sprocket detacheably connected to said cam shaft end portion externally of said cylinder head, said cam shaft carrying selectively operable decompression means for opening said exhaust valves at a time during the normal compression stroke for reducing the compression ratio therein for facilitating manual starting of said engine, and decompression actuating means supported in a bore opening from said end portion and accessible at said one end of said cam shaft for operating said selectively operable decompression means for selectively reducing the compression ratio of said engine upon manual starting, said decompression actuating means being removable from said cam shaft bore without removal of said driving sprocket from said cam shaft or removal of said cam shaft from said cylinder head.

2. An internal combustion engine as set forth in claim 1, wherein the decompression actuating means is automatically responsive to decrease the compression ratio if the engine crankshaft is rotated at a speed lower than a predetermined speed.

3. An internal combustion engine as set forth in claim 2, wherein the decompression actuating means is removable from the one end of the cam shaft without necessitating disassembly of the engine.

4. An internal combustion engine as set forth in claim 3, wherein the driving sprocket is detachably connected to the camshaft by a pair of threaded fasteners disposed on diametrically opposite sides of the axis of rotation of the camshaft and wherein the actuating means operator comprises a pair of centrifugal weights fixed to the driving sprocket and pivotable about axes disposed on diametrically opposite sides of the camshaft axis and disposed between the threaded fastening means.

5. An internal combustion engine as set forth in claim 1, wherein the cam shaft includes at least one exhaust cam lobe for actuating each exhaust valve, said exhaust cam shaft having further bores extending transversely to the first mentioned bore in proximity to each of said cam lobes and slidably supporting a respective plunger movable between a retracted position wherein the operation of the associated exhaust valve is not effected and an extended position wherein the associated exhaust valve is opened at a time other than when the exhaust valve is opened by said exhaust cam lobe.

6. An internal combustion engine as set forth in claim 5, wherein the plungers are disposed in diametrically opposite relationship to the lift portion of the associated exhaust cam lobe.

7. An internal combustion engine as set forth in claim 6, further including biasing means for urging the plungers to their retracted non-decompression positions.

8. An internal combustion engine as set forth in claim 7, wherein the decompression actuating means comprises a cam element slidable in the cam shaft bore.

9. An internal combustion engine as set forth in claim 8, wherein the cam element is a rotating cam element rotatable about an axis defined by the bore and coaxial with the axis of rotation of the cam shaft.

10. An internal combustion engine as set forth in claim 9, further including an operating device mounted at the one end of the cam shaft for operating the cam element.

11. An internal combustion engine as set forth in claim 10, when the decompression actuating device comprises a centrifugal mechanism for actuating the decompression plunger to its decompression position when the speed of the cam shaft is below a predetermined speed.

12. An internal combustion engine as set forth in claim 11, further including means extending through the cam shaft at the one end thereof for lubricating the centrifugal mechanism.

13. An internal combustion engine as set forth in claim 1, wherein the engine is supported so that the cam shaft and the crankshaft rotate about a vertically extending axis.

14. An internal combustion engine as set forth in claim 13, in combination with an outboard motor that is comprised of a powerhead containing the engine and a surrounding protective cowling and a drive shaft housing and lower unit depending from said powerhead and containing a drive shaft driven by said engine and a propulsion device driven by said drive shaft for propelling an associated watercraft.

15. An internal combustion engine as set forth in claim 14, further including a recoil starter affixed to the upper end of the crankshaft for pull starting of said engine, the cam shaft drive being also at said upper end of said crankshaft.

* * * * *